US011040240B1

(12) United States Patent
Powers

(10) Patent No.: US 11,040,240 B1
(45) Date of Patent: Jun. 22, 2021

(54) EXERCISE DEVICE FOR NECK AND UPPER BODY

(71) Applicant: Mitchell Powers, Vancouver, WA (US)

(72) Inventor: Mitchell Powers, Vancouver, WA (US)

( * ) Notice: Subject to any disclaimer, the term of this patent is extended or adjusted under 35 U.S.C. 154(b) by 0 days.

(21) Appl. No.: 16/446,268

(22) Filed: Jun. 19, 2019

Related U.S. Application Data

(63) Continuation-in-part of application No. 15/099,920, filed on Apr. 15, 2016, now Pat. No. 10,625,116.

(60) Provisional application No. 62/212,949, filed on Sep. 1, 2015.

(51) Int. Cl.

| | |
|---|---|
| ***A63B 21/04*** | (2006.01) |
| ***A63B 23/025*** | (2006.01) |
| ***A63B 21/002*** | (2006.01) |
| ***A63B 21/055*** | (2006.01) |
| ***A63B 21/00*** | (2006.01) |

(52) U.S. Cl.
CPC ..... *A63B 23/025* (2013.01); *A63B 21/0023* (2013.01); *A63B 21/0552* (2013.01); *A63B 21/4039* (2015.10); *A63B 2225/09* (2013.01)

(58) Field of Classification Search
CPC ... A63B 21/4003; A63B 21/078; A63B 23/02; A63B 2001/1607; A63B 2023/0411
See application file for complete search history.

(56) References Cited

U.S. PATENT DOCUMENTS 4,066,259 A 1/1978 Brentham
4,278,249 A 7/1981 Forrest
4,893,808 A 1/1990 McIntyre et al.
5,100,131 A * 3/1992 Fong ..... A61H 1/0292 482/112
5,135,445 A 8/1992 Christensen et al.
5,242,347 A 9/1993 Keeton
5,683,334 A 11/1997 Webber
5,971,895 A 10/1999 Habing
6,106,437 A 8/2000 Brooks
7,104,926 B2 9/2006 Carlson
7,699,756 B2 * 4/2010 Piane, Jr. ..... A63B 71/0036 482/38
7,981,010 B1 7/2011 Webber et al.
8,038,588 B2 10/2011 Hobson et al.
8,057,367 B2 11/2011 Giannelli et al.
8,096,929 B2 1/2012 Habing et al.
8,337,370 B2 * 12/2012 Rogers ..... A63B 71/0036 482/104
8,876,665 B1 11/2014 Isom
9,044,643 B2 * 6/2015 Staten ..... A63B 21/078
9,216,314 B2 * 12/2015 Chen ..... A63B 21/16
9,295,870 B2 * 3/2016 Mikulski ..... A63B 21/0442
9,656,116 B2 5/2017 Giannelli et al.
(Continued)

*Primary Examiner* — Joshua T Kennedy

(74) *Attorney, Agent, or Firm* — Chernoff, Vilhauer, McClung & Stenzel, LLP

(57) ABSTRACT

An exercise device (200) which a user (220) communicates with a base unit (260) whose shape comprises of a first arm projection (340) that ends with a first end (380) located along a radiating line from the base unit (260), and comprises of a second arm projection (440) that ends with a second end (420) ending somewhat away from the base unit (260) in a shape that contacts the user's head, whereby upon the urging of the user of the first end (380) produces at the second end (420) a force onto the user when the second end (420) is at least in contact with the user's head.

10 Claims, 14 Drawing Sheets

(56) References Cited

U.S. PATENT DOCUMENTS

| | | | | |
|---|---|---|---|---|
| 9,907,991 | B2 * | 3/2018 | Leipheimer | A63B 21/0783 |
| 10,086,226 | B2 * | 10/2018 | Nelson | A63B 21/4035 |
| 10,159,866 | B2 * | 12/2018 | Carter | A63B 21/0087 |
| 10,183,190 | B2 * | 1/2019 | Holland | A63B 21/0552 |
| 2003/0148863 | A1 | 8/2003 | Thomas | |
| 2006/0264304 | A1 | 11/2006 | Habing | |
| 2009/0187128 | A1 | 7/2009 | Nagabhushan | |
| 2010/0227742 | A1 * | 9/2010 | Jutte | A63B 21/16 482/87 |
| 2010/0292051 | A1 | 11/2010 | Benumof et al. | |
| 2015/0273263 | A1 * | 10/2015 | Guttman | A63B 3/00 482/129 |
| 2019/0247701 | A1 * | 8/2019 | Sergakis | A63B 21/078 |
| 2020/0069999 | A1 * | 3/2020 | McGovern | A63B 23/025 |

* cited by examiner

EXERCISE DEVICE FOR NECK AND UPPER BODY

CROSS REFERENCE TO RELATED APPLICATIONS

This application is a continuation-in-part of U.S. patent application Ser. No. 15/099,920, filed Apr. 15, 2016, which claims the benefit of U.S. Provisional Patent Application No. 62/212,949, filed Sep. 1, 2015.

The following is a tabulation of some prior art that presently appears relevant:

| U.S. Patents | | | |
|---|---|---|---|
| Pat. No. | Kind Code | Issue Date | Patentee |
| US 2003/0148863 | A1 | Aug. 7, 2003 | Thomas |
| U.S. Pat. No. 4,893,808 | B2 | Jan. 16, 1990 | McIntyre et al. |
| U.S. Pat. No. 8,876,665 | | Nov. 4, 2014 | Isom |
| US 2010/0292051 | A1 | Nov. 18, 2010 | Benumof |
| Non Patent Literature Documents | | | |
| None | | | |

BACKGROUND

Prior Art for Disbursement Apparatus

Sports are common activities of our past time from eons ago. It is greatly intensified when it has now matured into commercial entities where fame, power, and money are at stake. Many of our sports involve physical contact or sudden maneuvers, that can cause systemic and also catastrophic injuries to the athlete. One of the most common but under-addressed injury is to the neck and its surrounding region. And one of the most common neck injuries happens when a person's body comes to a sudden stop, causing the still-moving head to rely on neck resistance to bring it to full but later rest. This type of injury is aggravated further when two bodies collide. Another more common form is helmeted sports such as Football, where impact to the helmeted head causes tremendous neck stress and unnatural displacement/orientation. This form of injury has recently become very public when the National Football League (NFL) had to settle with retired NFL players suffering from this form of injury as well as brain related mental health issues. Sports have become big money, and in doing so, it has up the ante on the intensity of the sport as well as the consequential injury.

As result of the above, there is an increase in urgency to rehabilitate as well as prevent these injuries.

One of the most visible solutions to neck injuries and head trauma is to strengthen the neck using resistance-based exercises in conjunction with their corresponding devices. Although these exercises work the neck, they fail to exercise the neck and its nearby body regions in the position on impact. This impact orientation is important because it orients and displaces the vertebrae, muscles, tendons, ligaments in its most vulnerable position.

There are two common forms of exercises; isotonic and isometric muscle contraction. The difference between these two contractions is while isometric maintains a joint angle while increasing the work-load to the muscle, isotonic has both a joint angle change and a concentric (shortening) and eccentric (lengthening) motion of that muscle. An example of isometric is to hold a cup while pouring water into it. An example of isotonic is the flexing and relaxing of the bicep muscle.

The most optimal strengthening device has the ability to concurrently offer both isotonic and isometric forms of strengthening. This is especially true in the head impact scenario where the head is relatively stationary on impact. It is in this scenario that the impact puts a tremendous stress to the neck when resisting the impact energy that is now displacing this head from its pre-impact position. The goal in this case is to minimize this displacement so as to minimize the injury. Therefore, isometric strengthening of the neck with the head in an impact position strengthens the necessary organs and muscles necessary to resist this displacement.

It is also beneficial to combine isotonic strengthening to isometric strengthening. A football tackle injury is often the result of both isotonic and isometric muscle contraction, with the stationary head in impact position as isometric compression, and the arms closing in on the tackle as the isotonic movement. Therefore, strengthening can be maximized having the head strengthening in isometric compression, while the arms are outstretched in an isotonic strengthening motion.

Currently, there is a dearth of devices that simulates the head placement, outstretched arms and pulling motion in one fluid motion with all of the muscles of the neck, upper back and upper extremities working together to form a stronger unit.

The intensify of competition in Sports has now required athletes to maintain their conditioning beyond the gym. It is now required that they stay in their peak performance, whether out of season or outside the gym. As a result, conditioning and strengthening devices that can be used at home or during road trips in hotels have become more and more main-stream. This continuous conditioning regiment, no matter the place, convenience of time, or comfort of the gym, has become a very important factor in today's sports climate of peak performance, and of injury avoidance. Therefore, the flexibility of a strengthening device that is portable for road travels, as well as a home-based device, is highly desirable to the serious athlete.

Additionally, the strengthening device must be capable to adjust to the differing statures of the user. This adjustability feature is not only for ergonomic reasons, but also allows the user to tailor the settings to push his or her conditioning to the extreme. The head adjustment that tilts the head under isometric compression allows the user such extreme range of conditioning.

Aside from the adjustability considerations above, the strengthening device must be safe for usage, allowing the user to be in full control in applying forces especially to the neck area. This full control feature is so that in the event the user loses control of the operations of such device, or suffers lapses of concentration, the device is able to return to a neutral position that removes any possibility of injury. This is even more important with the neck as the spinal cord once injured can often become irreparable damage that often leads to permanent immobility.

Another important feature in exercising the neck is for a machine that puts an axial force/load on the cervical and upper thoracic spine while performing isometric cervical exercise and isotonic upper extremity exercise. This axial force on the cervical and upper thoracic spine is similar to the axial forces which occur during tackling sports such as football and wrestling. Even though there currently are devices performing isometric and isotonic neck exercises that strengthen the muscles, ligaments and soft tissues of the cervical spine, there is a dearth of devices that uses the axial force to strengthen the vertebral bodies, vertebral disc, and posterior joints of the cervical spine. This axial strengthening will address compression fractures of vertebral bodies. This type of axial injury sends broken pieces of the posterior vertebral body into spinal canal usually resulting in paralysis. The axial load is also critical in stimulating bone growth (strength) in the inner bone cortices. This growth points to Wolff's Law, a bone strengthening model developed by German anatomist and surgeon Julius Wollf, that states that bone in a healthy person or animal will adapt to the load under which it is placed. It also states that if loading on a bone is increased, the bone will remodel itself over time to become stronger to resist that load.

Another ailment common to both sports and non-sports participants is the loss of cervical lordotic curve. This loss is a major contributor to neck pain and tension. A loss of the normal curve, or reversal of such curve, is also responsible for an increase in the speed of deterioration and arthritis of the spine. The resultant injury from a helmet-to-helmet collision is reduced when the lordosis/curve acts like a spring to absorb the forces produced from such collision. As a result, concussion and brain injury are also reduced. Without the energy absorbing properties from a proper lordotic curve, stress from such collision is then deferred to the vertebral bodies, brain, and inter-vertebral discs to absorb the force, causing severe injury. Additionally, a proper lordotic curve shortens the lever arm that has the head impact on one end, and the connection to the upper thoracic spine on the other rnd. This shorter lever arm decreases whiplash injury and mid brain injury in all contact sport collisions. There is currently a dearth of devices that can restore or induce normal lordotic curvature while simultaneously strengthen the neck and upper extremities mentioned above. Such device would have a set of axial forces top to bottom, and front to back, forces produced while operating the device in other ways beneficial to the upper body, as means to promote the necessary and healthy lordotic curve.

In reference to a FIG. 1 embodiment as shown in Patent US 2003/0148863 A1 issued on Aug. 7, 2003 to Thomas, this Thomas embodiment does not meet the challenges of restoring lordotic curvature, of strengthening the neck and upper body in the orientation that simulates conditions at the point of impact, and of exercising the upper body and back in conjunction with strengthening the neck.

In reference to the above FIG. 2 embodiment as shown in U.S. Pat. No. 4,893,808 B2 issued on Jan. 16, 1990 to McIntyre et al, this McIntyre embodiment only has cervical flexion and extension, lateral displacement, and rotation. Not only it lacks any exercising of the upper body and back, but it also does not induce a lordotic curvature.

In reference to the above FIG. 3 embodiment as shown in U.S. Pat. No. 8,876,665 issued on Nov. 4, 2014 to Isom, this Isom embodiment relies on the user standing up against the head pad to generate the axial forces that lead to neck strengthening. However, helmeted head impact force is often in the axis 90 degrees from this vertical force, thus Isom's art does not completely simulate the real-world conditions and dynamics for strengthening. Additionally, the head pad is free to rotate about the attaching arm, and thus Isom's art is unable to induce proper lordotic curvature. Additionally, Isom's art lacks any exercising of upper body and back.

In reference to the above FIG. 4 embodiment as shown in Patent US 2010/0292051 A1 issued on Nov. 18, 2010 to Benumof, this Benumof embodiment is unique in the sense that it allows neck exercise in conjunction with arms exercise through a series of interconnecting cables between the head and hands. Additionally, Benumof s art is compact, lightweight, and user friendly enough for home and travel use. However, Benumof s art suffers from the inability to set lordotic curvature due to the cable connections unable to constrain the head in both flexion and compressive mode. Additionally, Benumof s art does not exercise the upper body and upper back so as to support the neck as core supporting muscles. It also does not place the user's arms and hands in the same collision impact position to simulate a football tackle.

ADVANTAGES

Accordingly, several advantages of one or more aspects are as follows: to have a exercise device that is inexpensive to produce, that allows the user to be in full control so that the device auto-returns to a neutral position in case the user inadvertently loses control of operating the device, that has the ability to induce corrective lordotic neck curvature, that has the ability to exercise and strengthen the upper body and back as core supporting muscles for the neck, that has the ability to provide axial neck strengthening, that has the ability to accomplish the above in a concurrent manner, that is adjustable for ergonomics and for simulating real collision conditions and for extending the strengthening range, and that is portable.

BRIEF DESCRIPTION OF THE DRAWINGS

Notice: A portion of the disclosure of this patent document contains material that is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

ALTERNATE EMBODIMENTS

Figure 7:
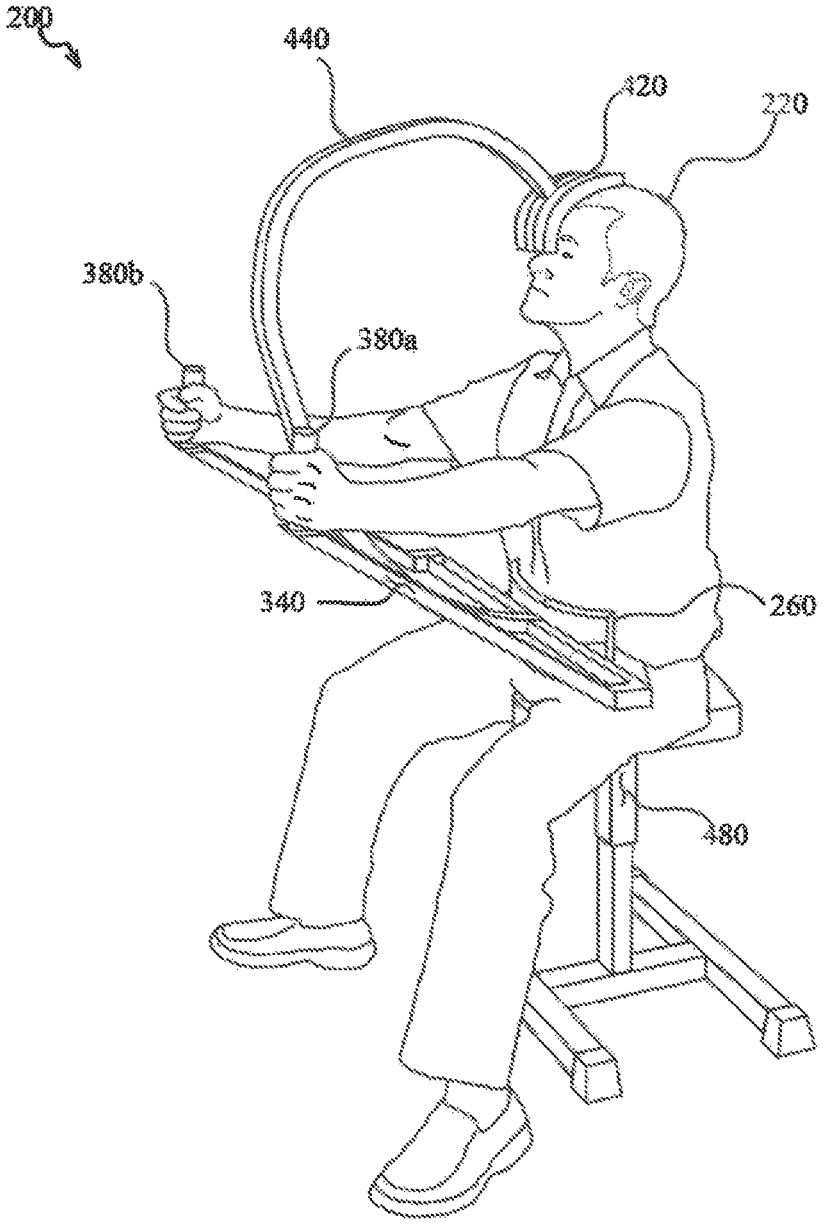
Figure 8:
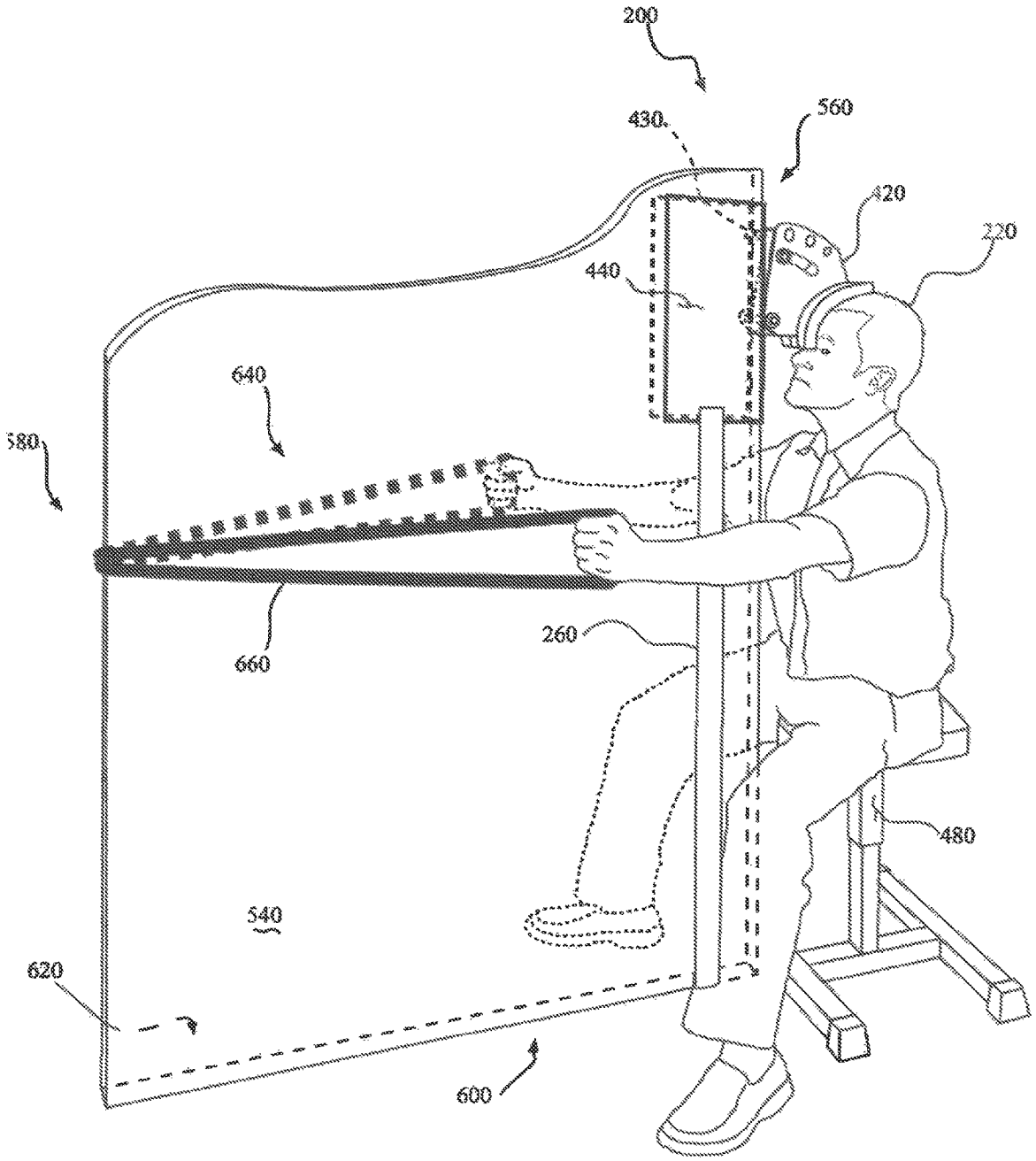
Figure 9:
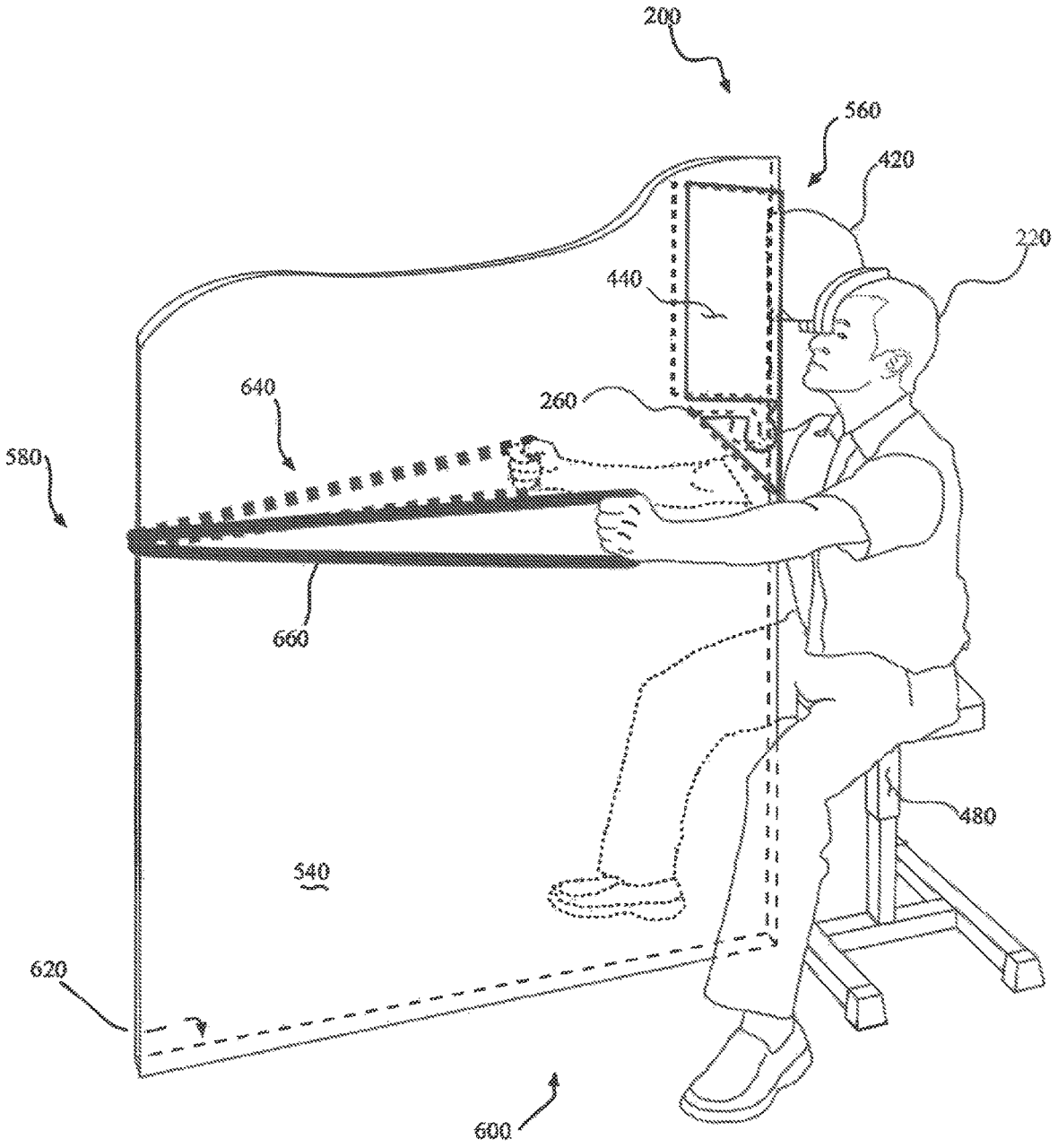
Figure 10:
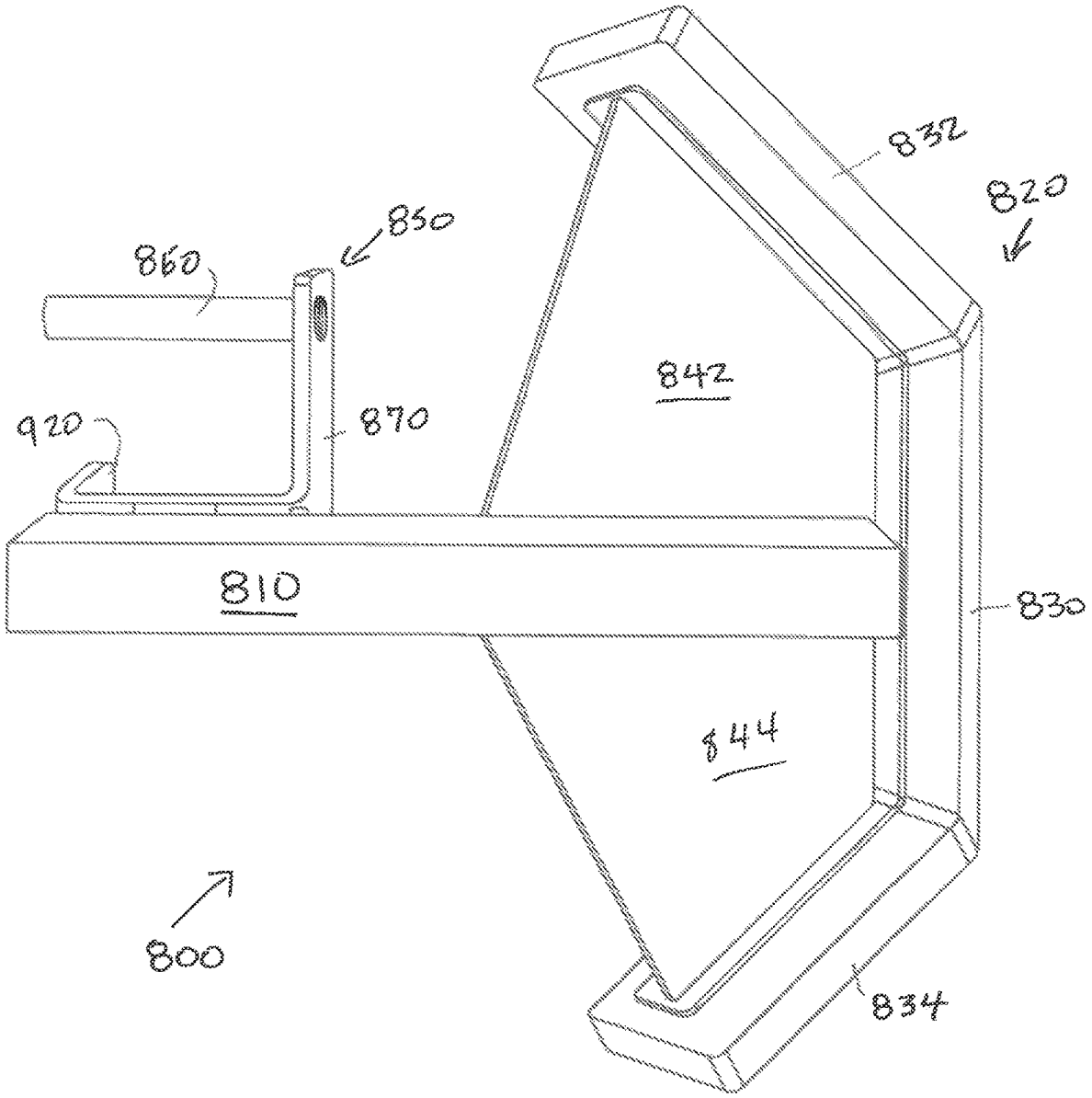
Figure 11:
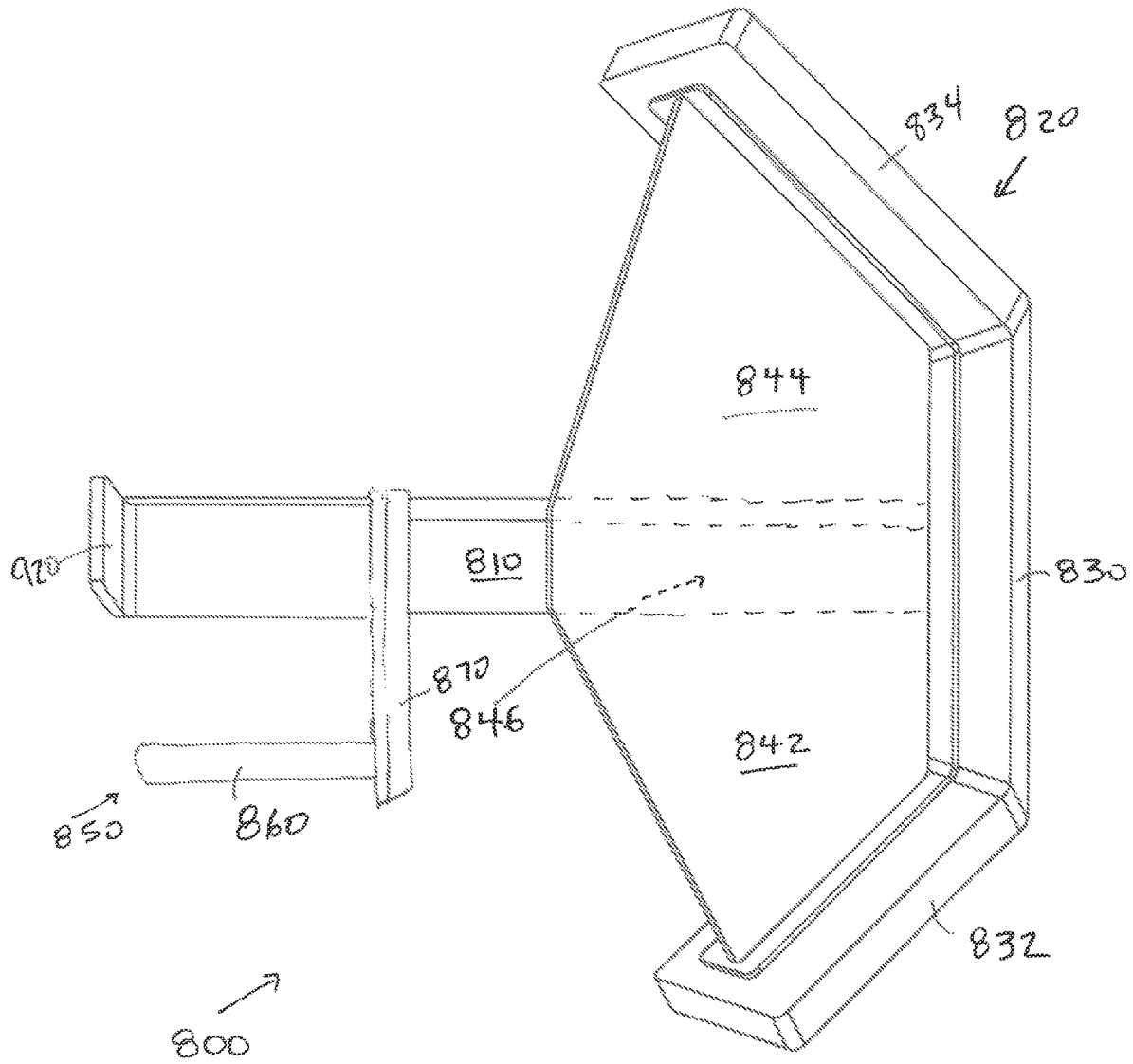
Figure 12:
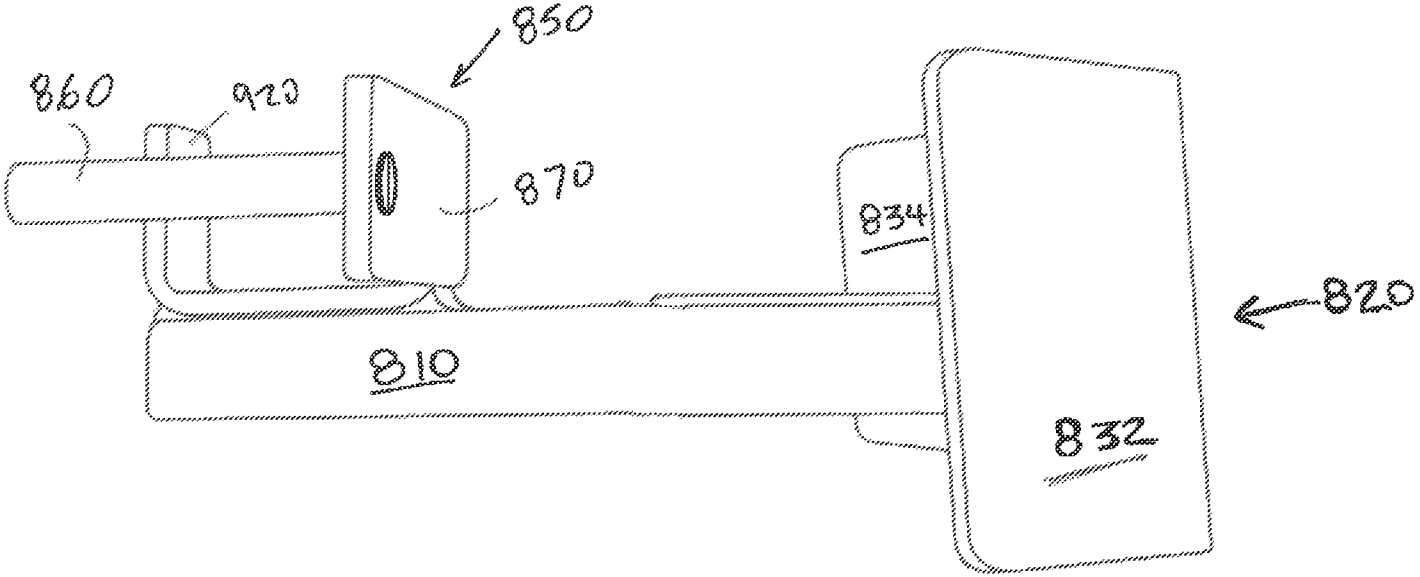
Figure 13:
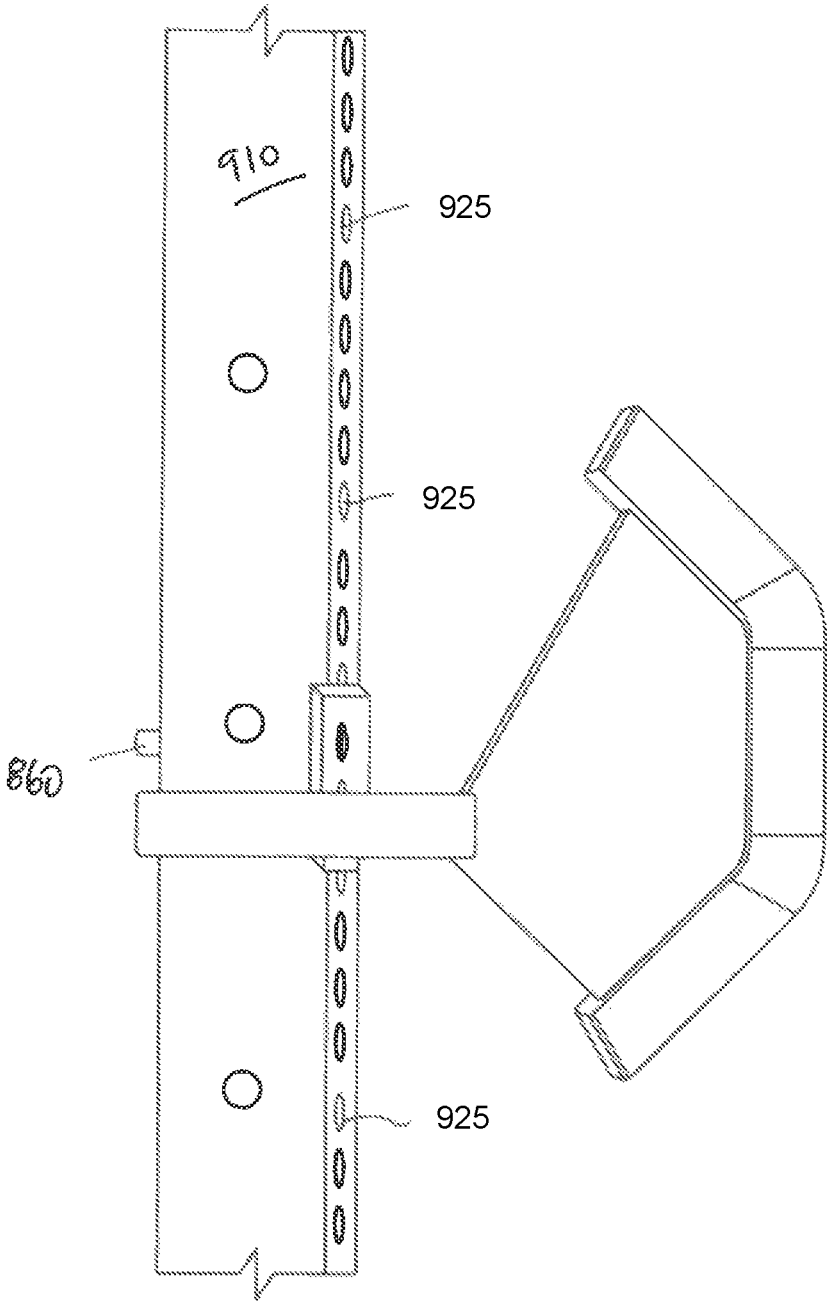
Figure 14:
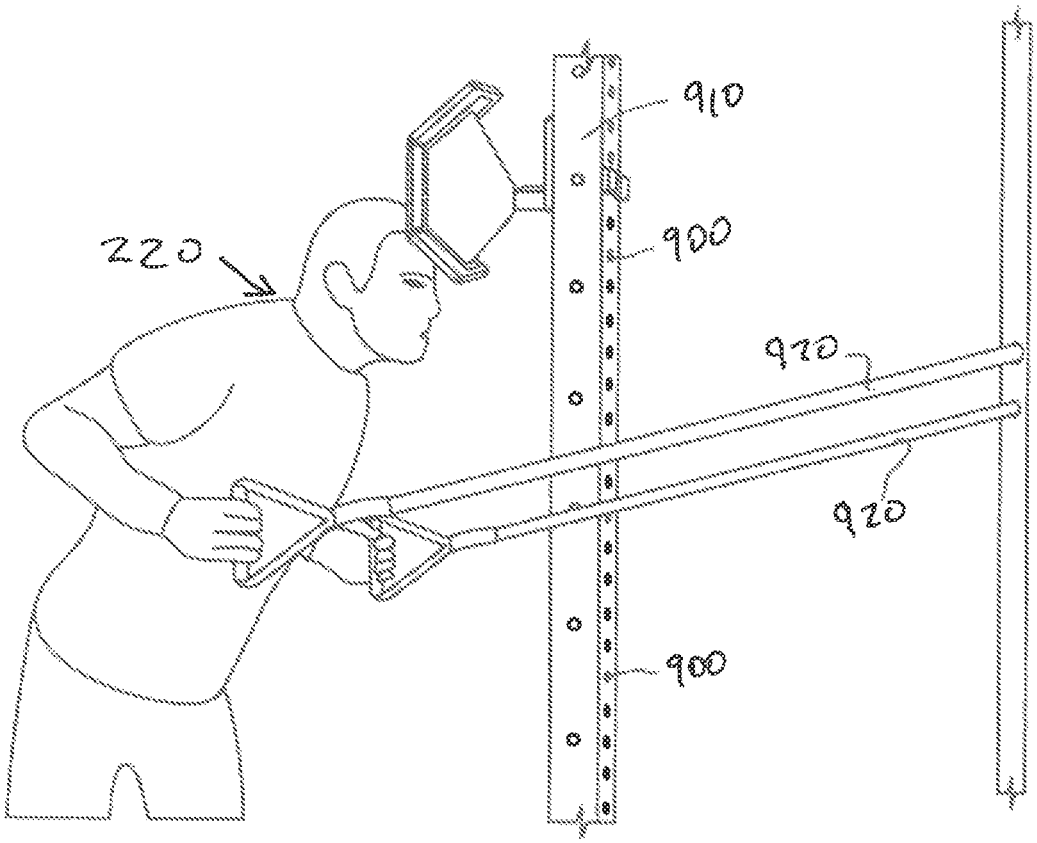

FIG. 7 illustrates a perspective view of the Exercise Device in a First Alternative Embodiment;

FIG. 8 illustrates a perspective view of the Exercise Device in a Second Alternative Embodiment;

FIG. 9 illustrates a perspective view of the Exercise Device in a Third Alternative Embodiment;

FIG. 10 illustrates a first side view of another embodiment of an exercise device;

FIG. 11 illustrates a second side view of the exercise device of FIG. 10;

FIG. 12 illustrates a top view of the exercise device of FIG. 10;

FIG. 13 illustrates a side view of the exercise device of FIG. 10 connected/coupled to a support;

FIG. 14 illustrates a side view of the exercise device of FIG. 10 connected/coupled to a support together with a user and a resistance band;

DRAWINGS—REFERENCE NUMERALS

| | | | |
|---|---|---|---|
| 200 | Exercise Device | 220 | Operator |
| 240 | Frame Assembly | 260 | Base Support End |
| 280 | Arm Support End | 300 | Seat Support End |
| 320 | Head Fitting Unit Support End | 340 | Arm |
| 360 | Arm Pivot End | 380 | Left and Right |
| 380 | Left and Right | A&B | Handle |
| C&D | Weight Handle | | |
| 400 | Head Fitting Assembly | 420 | Head Contact Unit |
| 430 | Spring Loaded Pin | 440 | Head Fitting Arm |
| 460 | Sliding Bracket | 470 | Locking Screw |
| 480 | Seat Unit | 500 | Seat End |
| 520 | Post End | 540 | Door |
| 560 | Latching edge | 580 | Hinge Edge |
| 600 | Interior Side | 620 | Exterior Side |
| 640 | Force Resistant Device | 660 | Elastic Flexible Member |

SUMMARY

Embodiments

In some aspects an exercise device to be used by a user is disclosed. The apparatus which an user (220) communicates with, comprises a base unit (260) whose shape comprises a first arm projection (340) comprising 1) a first end (380 A) ending along a radiating line from the base unit (260), 2) a second arm projection (440) comprising a second end (420) ending somewhat away from the base unit (260) in a shape that contacts the user's head; whereby upon the urging of the user of the first end (380 A) produces at the second end (420) a force onto the user when the second end (420) is at least in communication with the user's head.

Optionally, the second end (420) substantially conforms to a portion of the user head apparatus comes in contact with.

Optionally the second end (420) is in contact the underside of the user's head substantially in the chin and throat area, whereby any force onto user will cause a traction load onto the user's neck region.

Optionally, the first end (380A) terminates in a location substantially in line with the user's shoulder and at a height between the user's shoulder and waist.

Optionally, the apparatus is coupled to a companion apparatus, the apparatus and the companion apparatus being symmetric relative to each other in at least one axis.

Optionally, wherein the second arm projection is separably coupled to the base unit (260), the second arm projection (440) further comprises of a third end (460), the third end (460) being configured to engage with the base unit (320 of 240) in a slidably and rotatably adjustable and locking manner.

Optionally, wherein the first arm projection (340) is separably coupled to the base unit (260), the first arm projection (340) further comprises of a fourth end (360), the first arm projection (340) being pivotally connected to the base unit (280 of 240) at the fourth end (360), and the user selectively communicating with the first arm projection at the first end (380 A).

Optionally, wherein the first arm projection (340) is coupled to a companion first arm projection (380B and D), the first arm projection (340) and the companion first arm projection being symmetric relative to each other in at least one axis.

Optionally, the head fitting unit (420) is pivotally and separably coupled to the second end in a selectably adjustable and locking manner, whereby the operation of the apparatus results in a force between the head fitting unit (420) and the user that can be adjusted into an at least substantially vertical force and an at least substantially horizontal force.

Optionally, the first arm projection further comprises of a fifth end (380C) that communicates with a force resistance device allowing the exercise device (200) to be used in conjunction with the force resistance device.

Optionally, the first arm projection and the companion first arm projection are connected in a slidably adjustable and locking manner, wherein the distance between the first arm projection and the companion first arm projection are adjustable in a user selectable manner.

Optionally, the fourth end (360) is pivotally connected to the base unit (280 of 240) in a configuration that applies a downward force onto user during user operation.

Optionally, the base unit (260) further comprises of a sixth end (300) that is substantially located to support user while operating the apparatus.

Optionally, the base unit (260) further comprises of a seating unit (480) that is slidably connected to the sixth end (300) in a selectably adjustable and locking manner.

In some aspects an exercise device (200) to be used by a user is disclosed. The exercise is to be used in conjunction with a rigid planar body (540) comprising a projection (Alternate Embodiment 2: Bottom edge of door/Alternate Embodiment 3: Door Knob, not drawn but cited) somewhat normal to the planar body, and is to be used in conjunction with a force resistance (640) device a user (220) communicates with. The exercise device comprises of a base (440) whose shape comprising of 1) a first end (420) ending along a radiating line from the base unit, and 2) an aperture (260) sufficiently large enough to communicate with the projection, wherein the base unit (440) is in communication with the rigid planar body (540), wherein the aperture (also known as base support end 260) is in communication with the projection, whereby upon the urging of the user with the force resistance device (640) produces a force onto the user when the first end (420) is in communication with the user's head.

Optionally, the exercise device (200) further comprises of an elongated member (260), wherein the base unit (440) communicates with the rigid planar body (540) in a stationary manner by means of the elongated member (260), wherein the elongated member (260) comprises a seventh and a eighth end, wherein the seventh end is connected to the aperture (slot 260 also) and the eighth end is connected to the projection (defined below).

Optionally, the projection comprise of an edge feature (cited) of the rigid planar body (540).

Optionally, the projection is a door knob (cited) and the rigid planar body is a door (540).

Optionally, the first end (420) substantially conforms to a portion of the user head apparatus comes in contact with.

Optionally, the exercise device (200) comprises of a head fitting unit (420) pivotally and separably coupled to the first end in a selectably adjustable manner; whereby the force onto the user can be adjusted into an at least substantially vertical force and an at least substantially horizontal force.

Figure 1:
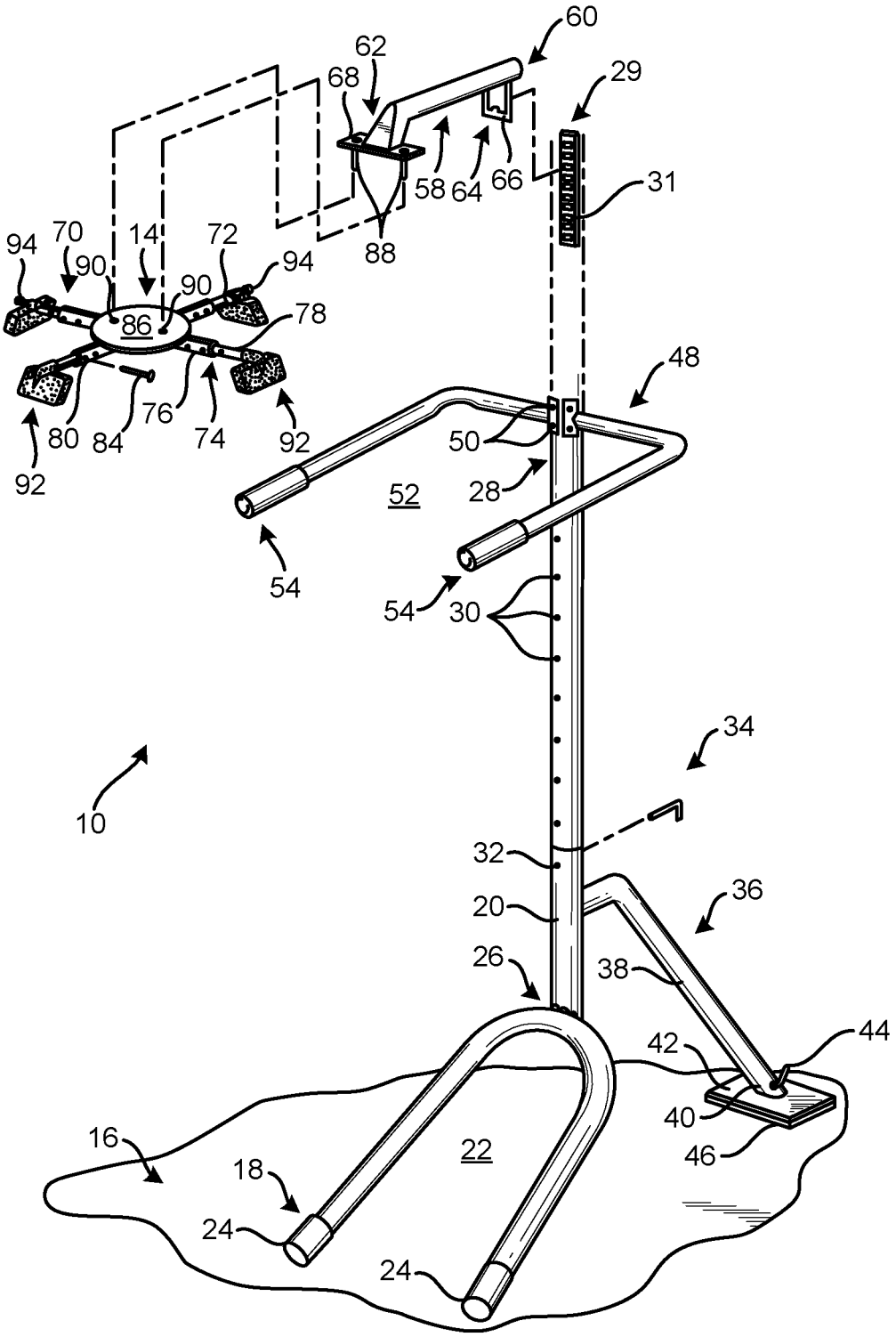
Prior Art FIG. 1
FIGS. 1 to 4 illustrate the illustrations of Prior Art as reference.
Figure 2:
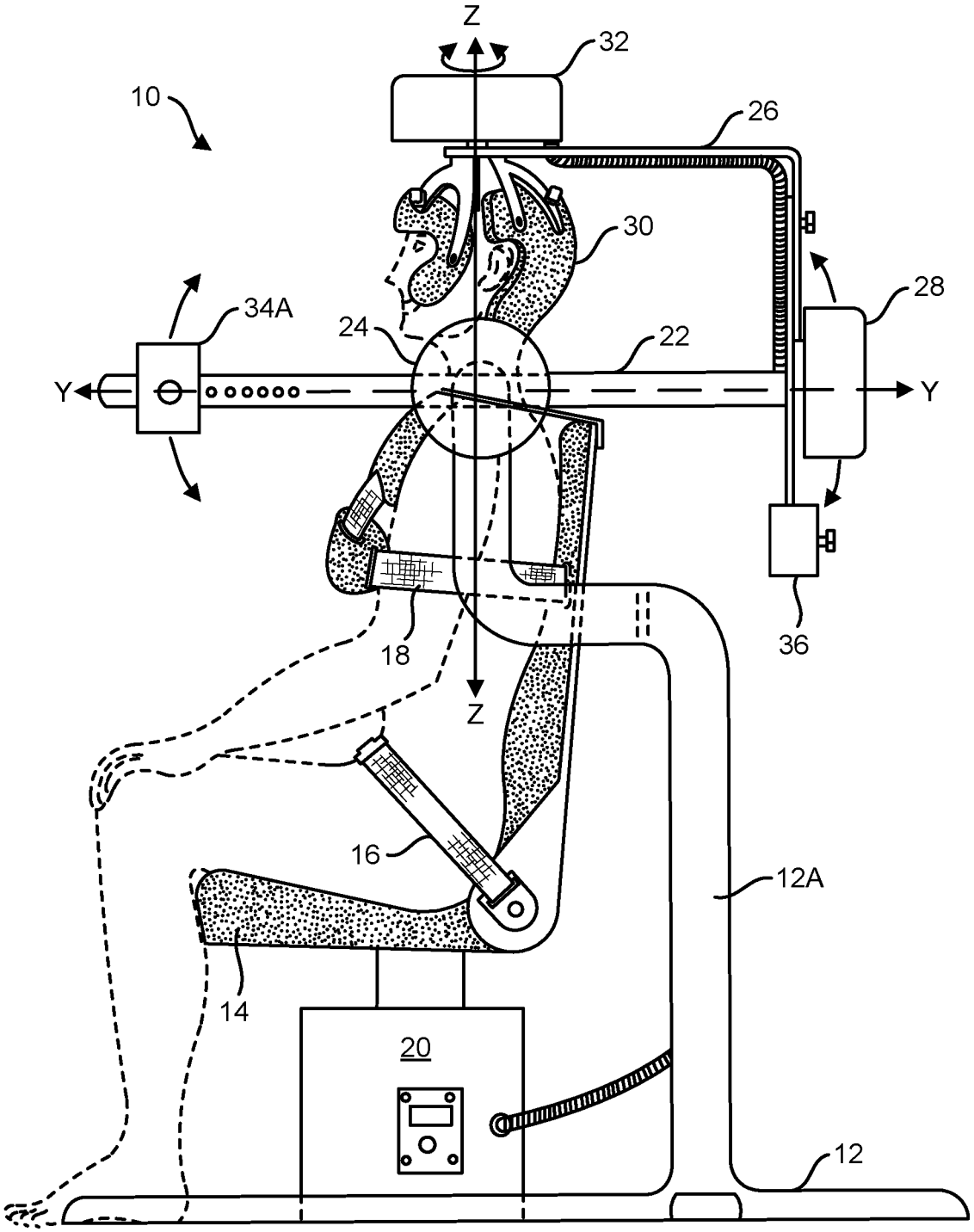
Prior Art FIG. 2
Figure 3:
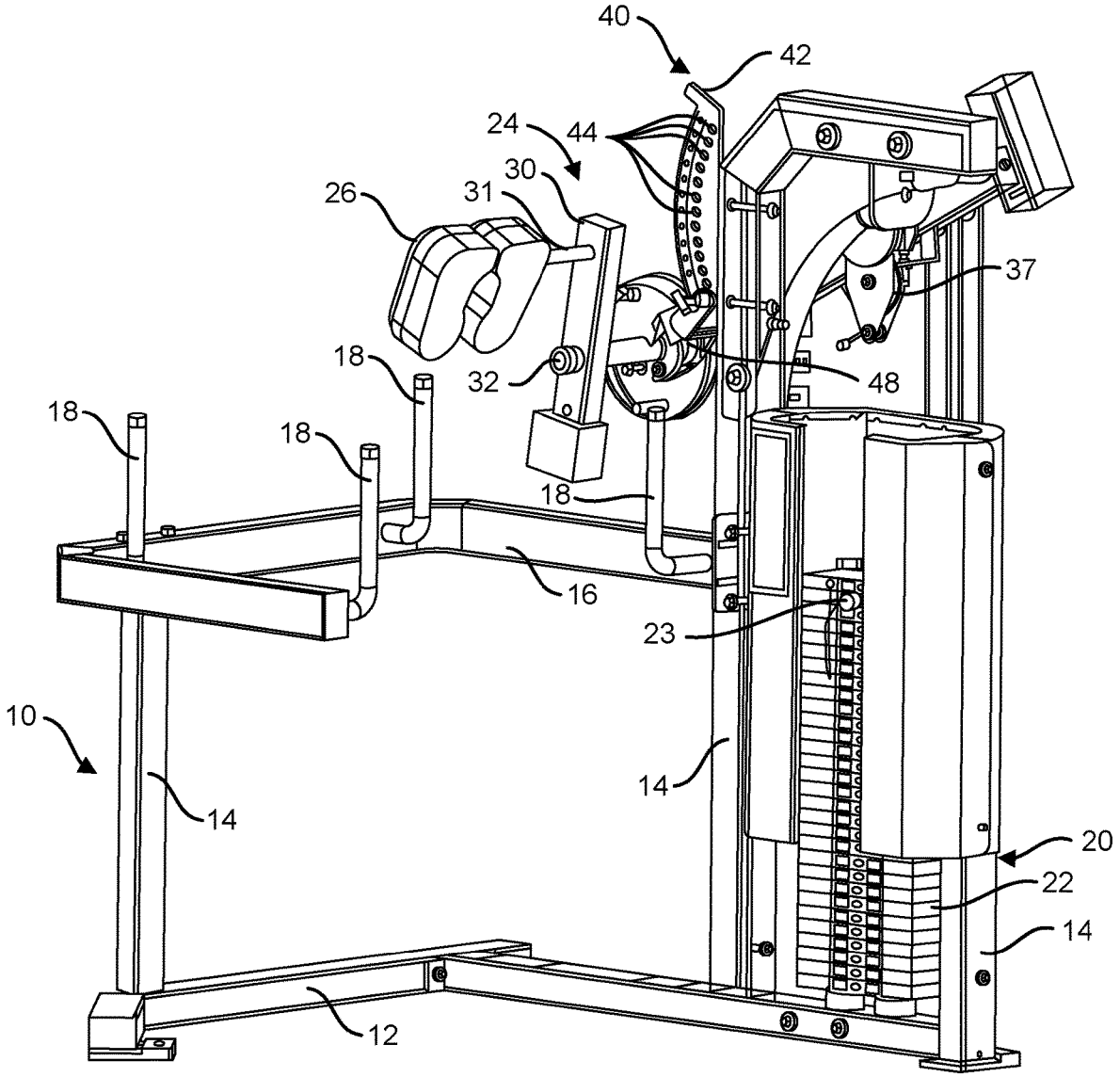
Prior Art FIG. 3
Figure 4:
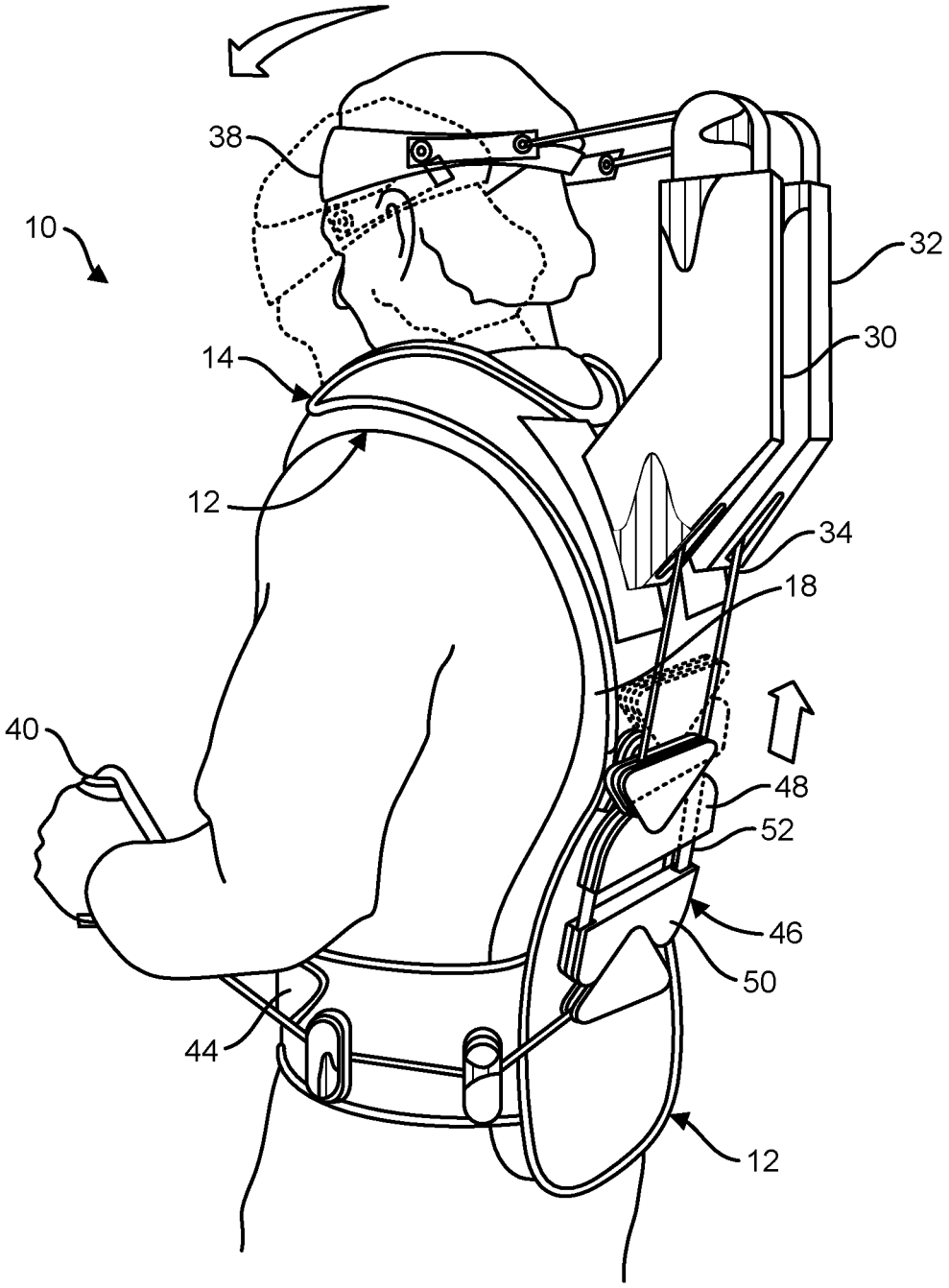
Prior Art FIG. 4
Figure 5:
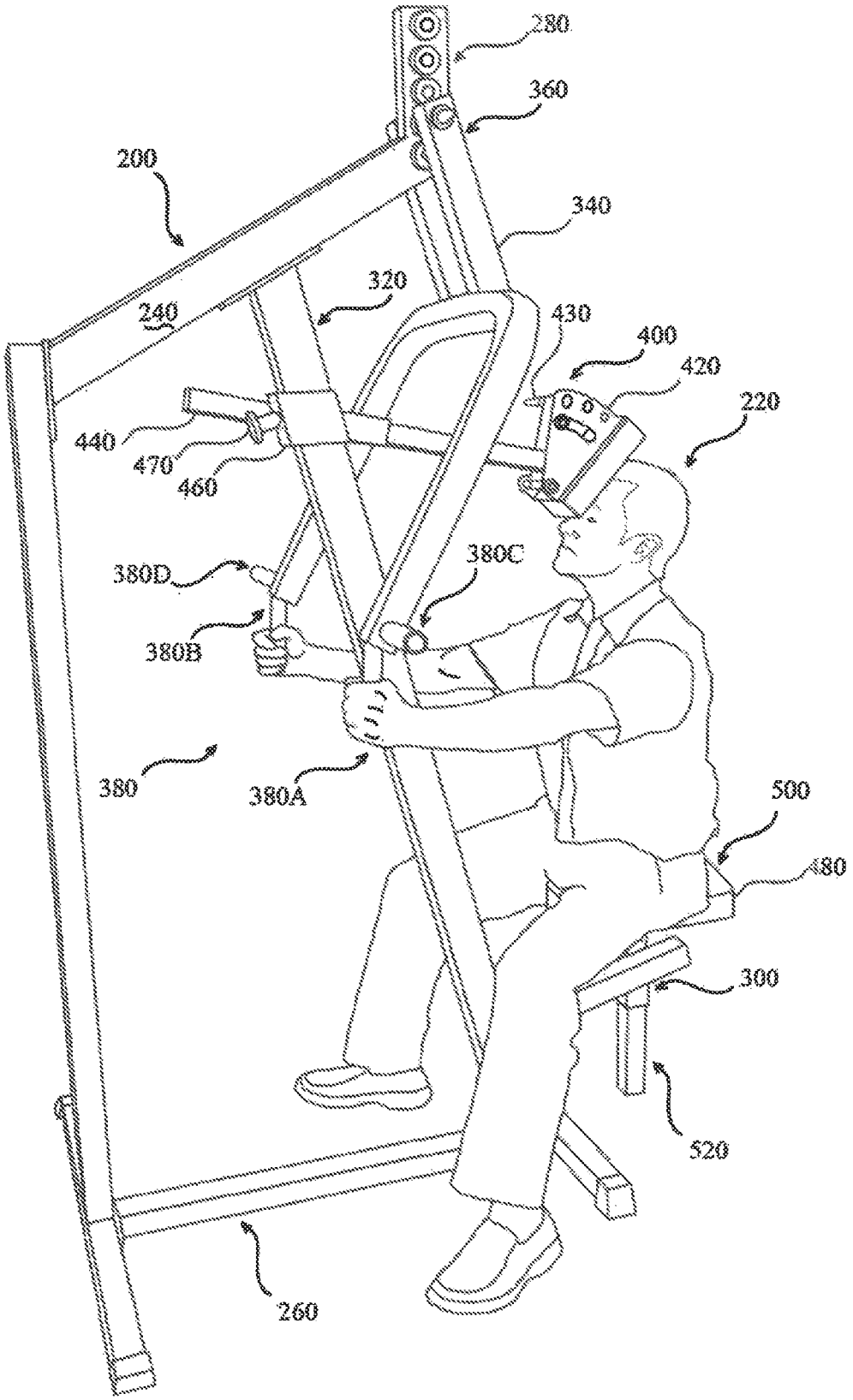
FIG. 5 illustrates a perspective view of the Exercise Device of the present Invention and an operator.
Figure 6:
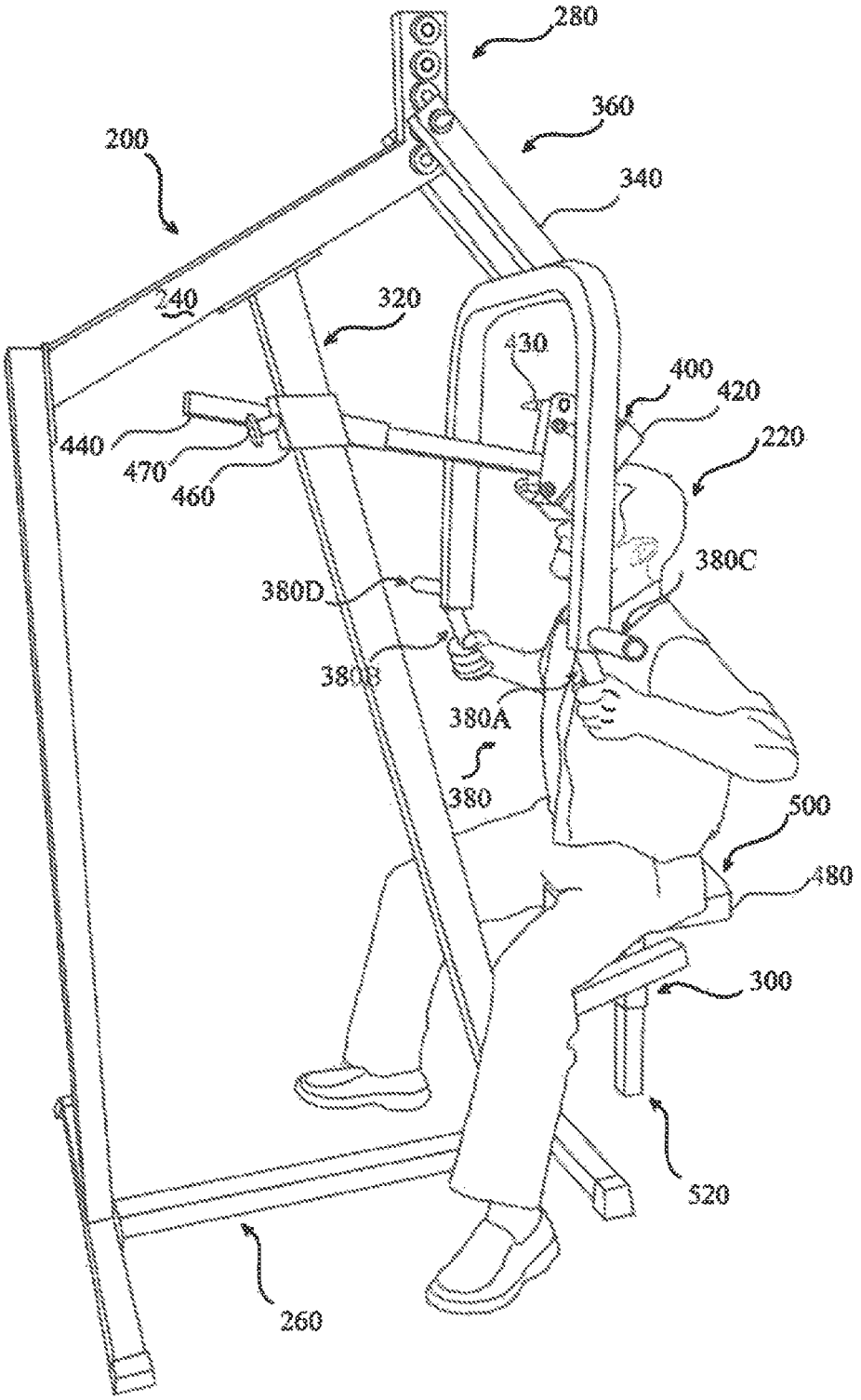
FIG. 6 illustrates a perspective view of the Exercise Device in a retracted position.

Detailed Description of Main Embodiment, FIGS. 5 and 6

This Left Side teaching is repeated for the Right Side of the figures, and vice versa, as the embodiment is symmetrically identical on both sides where applicable, with the part callout having an 'A' part name for the Left side and '13' part name for the Right Side for teaching purposes. Whenever there is no subpart name, it is assumed the right side for left side teaching and vice versa is still preserved.

While the configurations according to the illustrated embodiment are preferred, it is envisioned that alternate configurations of the present invention may be adopted without deviating from the invention as portrayed.

The preferred embodiments are discussed hereafter.

Referring first to FIG. 5, a perspective view of an Exercise Device of the present invention, generally indicated as 200, and an operator, generally indicated as 220, are shown.

The exercise device 200 comprises of a Frame Assembly 240. The frame assembly comprises of a 1) Base Support end 260, an 2) Arm Support End 280, a 3) Seat Support end 300, and a 4) Head Fitting Unit Support End 320.

In reference to 1), the Base Support end 260 supports the exercise device 200 in a stable manner on a flat surface, such as a floor, so as to allow safe, stable, and effective use of the device 200. In reference to 2), the arm support end 280 allows an Arm 340 to connect to it in a pivoting manner. In reference to 3), the seat support end 300 allows a Seat Unit 480 to connect to it in a slidably adjusting manner. In reference to 4), the head fitting unit support end allows a Head Fitting Assembly 400 to connect to it in a slidably adjusting manner.

With reference to 3), the seat unit 480 comprises of a Seat End 500 and a Post End 520. The post end 520 slidably engages with the seat support end 300 in a selectively locking manner using a pin device to pass through one of many hole-features in post end 520 and a similar size hole in the seat support end 300. This pin-and-hole device is a known art and not currently illustrated in this embodiment. However, the current illustration shows the bottom planar surface of the seat end 500, a surface that roughly projects perpendicular to the axis of the post end 520, acts to lock the seat unit 480 downward which is further held in place by the operator's weight.

With reference to 4), the head fitting unit 400 is connected to the head fitting unit support end 320 by being slidably connected to a Sliding Bracket 460 in a selectably locking manner. The sliding bracket 460 is slidably connected to the head fitting support end 320 in a selectably locking manner. One optionally feature is to couple head fitting arm 440 to head fitting support arm 320 in a selectable angle manner. This would allow the arm 440 to rotate 180 degrees for multipurpose configurations. The Locking Screw 470 is manually locked to accomplish this selectably locking manner. This allows a largely vertical adjustment to the head fitting unit 400 to ergonomically adjust for the operator's ergonomics. The fitting unit 400 comprises of a Head Fitting arm 440 that slidably connects to the sliding bracket 460 in a selectably locking manner. This arm connection allows a largely horizontal adjustment to the head fitting unit to ergonomically adjust for the operator's ergonomics. Connected to the arm 440 is a Head Contact Unit 420 that pivots from the arm 440 so that the unit 420 allows the operator 220 to present his or her forehead's contact the unit 420 at a user defined angle. A Spring Load Pin 430 is mounted on the arm 440 and passes through a hole feature selected from a plurality of hole features present in the unit 420, effectively locking the user defined angle in place.

Operation: Apparatus, FIGS. 5 and 6.

In reference to FIG. 5, and although not required to fully function the Exercise Device 200, Operator 220 will maximize the benefits from using exercise device 200 by making the following adjustments to fit the exercise device 200 to his anatomical build prior to operating it.

The seat adjustment is preferred in the manner that the operator's feet are stable and suitably planted to the floor so that operator 220 incurs as little body and head movement during the cycling of the exercise device 200. The operator has the option of selectably adjusting the seat unit 480 so that the seat end 500 is of the sufficient height to accomplish the stable and suitably planted feet position.

The head fitting unit 400 contacts the operator 220 using the optional adjustments from 1) head contact unit 420, 2) head fitting arm 440, and 3) sliding bracket 460. The surface of the head contact unit 420 that comes in contact with the operator 220 can be adjusted and locked in to a predefined operator angle relative to a horizontal line. It is applicant's finding that the most optimal angle is 45 degrees, with a range of angles between 90 degrees (looking straight up vertically) and 0 degrees (looking straight on horizontally) providing sufficient. Operator 220 selects his angle by retracting the spring-loaded pin 430 in the manner that frees the pin from the hole feature of the head contact unit 420. Operator 220 can then pivot the head contact unit 420 relative to the head fitting arm 440 until a desired angle is achieved. Operator 220 then releases the spring-loaded pin from his hand so that the pin passes through the desired hole feature of head contact unit 420. This sets and locks the newly selected angle of the head contact unit 420.

In reference to the adjustments for the head fitting arm 440 and for the sliding bracket 460, both adjustments are performed together so that the head contact unit 420 contacts the operator's forehead with the operator 220 in the fully seated and stable manner mentioned earlier. Additionally, these adjustments are performed so that there is maximum surface contact between operator's forehead and the contact surface of head contact unit 420. This maximum contact will prevent hot spots in the contact pressure levels from contact, prolonging operator's comfort during the normal cycling of the exercise device 200. A largely horizontal adjustment to the head contact unit 420 position is to adjust the head fitting arm 440 relative to the sliding bracket 460 before locking it in position. A largely vertical adjustment to the head contact unit 420 position is accomplished with adjusting the sliding bracket 460 to the head fitting unit support end 320 before locking it with locking screw 470.

In reference to the vertical height location of the handles 380A and B relative to the operator 220, the operator has the option of adjusting the height from which the arm 340 can pivot relative to the frame assembly 240. This optional adjustment is made by pivotally connecting the arm pivot end 360 using one of the set of hole-features found in the arm support end 280. A preferred height is so that the operator 220 is able to pull the arm 340 with his hands ending up between his mid torso and his shoulder.

The operator 220 has the option of adding more resistance to the use of the exercise device 200 when it is used in conjunction with Force Resistance Devices of Known art. One option of a resistance device of known art is a set of stackable weights that can be mounted onto Left and Right Weight Handles 380C and D. Another option can also be a Stretchable Material, such as a stackable set of Elastomeric Elastic Loops, which is attached at a point on the arm 340, between the pivot end 360 and Handle end 380, and the frame 340. Another option would be a stackable weight in combination with a cable and pulley system whereby the cable is attached at a point on the arm 340, between the pivot end 360 and handle end 380, and the stackable weights are on the other end of the cable. These optional devices can be used with this exercise device 200 as a means to increase the head contact pressure between the head contact unit 420 and operator 220.

In reference to FIG. 6, Operator 220 has the option of operating one handle or both. However, a balance of forces is best accomplished when operator is pulling on both handles 380A and B. The teaching henceforth is for the one handle option that can be duplicated for the second handle option. From the seated position with the desired adjustments made, the operator 220 grabs Left Handle 380A with his Left Hand and simply pulls it towards him as comfortably close as possible to his body. If all adjustments were properly made, the left hand should end up between operator's mid torso and his shoulder. The operator 220 then has the option of holding the handle 380A in this close body position as long as desired. This holding is to provide Isometric benefits to the Operator's neck muscles and tissues. The operator 220, while in continuous hand contact with the handle 380A, then relaxes his shoulders and arm muscles so as to return to the handle 380A to the initial position at the beginning of this teaching. The operator can repeat this cycle at his preferred frequency and duration, a cycle that provides Isotonic benefits to the operator's upper body muscles and tissues. The operator can selectively change the handle 380A pulling resistance by changing the configuration of the optional Force Resistance Device that is being used in conjunction with the exercise device 200.

There is a Traction Load option that places the Head contact unit 420 underneath the head, in the chin and neck area. This places a Traction Load onto the neck, an alternate neck strengthening mode than the Forehead compression/Lordotic mode mentioned above. This traction mode would require sliding down the head fitting arm 440 relative to the sliding bracket 460 before locking it in a position that places the head contact unit 420 in such chin/neck position. This may also require the head contact unit 420 to be flipped 180 degrees in the bracket 460 so that its adjustable range can better conform to the chin/neck area to reduce hot spots or injury. This traction load adjustment to the Head contact unit 420 also requires relocating the pivot end 360 of the arm 340 to pivot from the set of holes the frame assembly 240 closer to support end 260 mentioned above. This new traction pivot configuration provides the option of lifting the arm 340 rather than pulling it towards the operator's chest center as currently illustrated. The user can then experience a downward force during operating this arm 340, and the head fitting unit 420 in the traction load location will thus resists the downward counteracting user force, imparting a traction load on the user's neck region.

Description—Alternative Embodiment FIGS. 7-9

First Alternative Embodiment

In reference to FIG. 7, a one-piece exercise device 200 is shown in the manner of intended use by operator 220. The exercise device 200 has a base support end 260 which both the arm 340 and head fitting arm 440 are connected to. One end of arm 340 is connected to base support end 260, while the other end is connected to handle 380*a*. One end of head fitting arm 440 is connected to base support end 260, while the other end is connected to handle head contact unit 420.

The head contact unit 420 is configured in a manner that resists the operator's 360 head in both the vertical and horizontal direction. In this alternate embodiment, the unit 420 is configured to have a 'C' shape so as to resists in the above-mentioned manner and to ergonomically accommodate for the operator's comfort.

The head fitting arm 440 is configured in a manner to allow the head contact unit 420 to self-adjusts to differing range of body builds and proportions as well as to differing head contact angles. In this alternate embodiment, these adjustments are accomplished with the curved 'C' shape in arm 440 that, when straightened out, will cause the head contact unit 420 to change both its angle and its position relative to base support end 260.

The arm 340 is configured in a manner that has a built in force-resistance function, foregoing any external force resisting devices mentioned for the Main Embodiment. The arm's 340 shape configuration on a multi-plane level allows the leg portions of the arm 340 to bend or twist, or a combination of both, producing resistance forces low enough that is both usable and within normal usage range. Additionally, the handles 380*a* and *b* can be spread further apart or brought closer to each to accommodate differing shoulder spans, an adjustability allowed by the above arm 340 configuration.

Operations:

Operator 220 brings the device 200 in a manner the base support end 260 substantially embraces the torso region. While grabbing both handles 380*a* and *b*, the operator raises his head underneath head contact unit 420 until it reaches its intended height, angle, and comfort.

The operator 260 can then adjust the spreading distance between handles 380*a* and *b* to a desired distance, typically his shoulder width apart with this distance centered on his body center line. Additionally, the operator 220 can then pull in or push out handles 380*a* and *b* to a desired ergonomic location.

Upon reaching the intended ergonomic settings, the operator 220 can apply a pulling force on both handles 380*a* and *b* along the path that connects his shoulders to his hand. This will cause the device 200 to rotate around the base support end 260, causing an increased in head resistance in both the vertical and horizontal direction. Additionally, and because handles 380*a* and *b* are higher than base support end 260, this pulling force may cause the device 200 to slide down causing the heading fitting arm 440 to straighten out even further. This straightening out however will increase the intended vertical and horizontal resistance against the operator's head.

Second Alternative Embodiment

In reference to FIG. 8, a multi-piece exercise device 200 is shown in the manner of intended use by the operator 220. The exercise device 200 comprise of a base support end 260 which connects to the head fitting arm 440. The other end of head fitting arm 440 end is connected to accommodate a head contact unit 420 in an adjustable angle manner.

The head contact unit 420 is configured in a manner that resists the operator's 220 head in both the vertical and horizontal direction. In this alternate embodiment, the unit 420 is configured to have a 'C' shape so as to resists in the above-mentioned manner so as to ergonomically accommodate for the operator's comfort.

The connection between head fitting arm 440 and the head contact unit 420 allows the operator to select the angle to suit differing range of body builds and proportions, as well as to differing head contact angles. In this alternate embodiment, these adjustments are accomplished with the retracting and releasing of spring-loaded pin 430 that is connected to the head fitting arm 440. The pin is retracted and released from and into the plurality of hole-features found in the head contact unit 420 to lock down the angle adjustment.

The head fitting arm is connected to base support end 260. In this embodiment, a strap is contemplated for the base support end 260.

It is contemplated that the operator 220 engages with a Force Resistance Device 640. It is contemplated at this time that device 640 comprises of an Elastic Flexible Member 660, that in this case is shaped in a continuous loop. The cross-section shape, stiffness, and material choice for member 660 are selected to produce resistance forces low enough that is both usable and within normal usage range. Because of the member's flexible nature, the hands can be spread further apart or brought closer to each to accommodate differing shoulder spans, an adjustability allowed by this member 660.

Operations:

The device 200 is to be used in conjunction with a Door 540 and a Force Resistance Device 640.

Operator 260 brings the device 200 in a manner that the head fitting arm 440 is placed against the door 540 so that the head contact unit is closest to the Latching edge side 560, embracing this side as well as both Interior Side 600 and Exterior Side 620. The free end of base support end 260 is connected to the bottom end of the door 540 and is adjusted for operator's ergonomics.

The operator 220 then loops the elastic flexible member 660, from the interior side 600 passing around the hinge edge side 580 all the way to exterior side 620, and grabs both ends of the loop. The operator then raises his head underneath head contact unit 420 until it reaches its intended height. The angle of head contact unit 420 is adjusted as described above to a desired angle. Further adjustments can be made to Seat unit 480 to fine tune any vertical adjustment.

Because of the flexible nature of member 660, the operator 260 can then adjust the spreading distance between his hands to a desired distance, typically his shoulder width apart with this distance centered on his body center line. Because of the elastic nature of member 660, the operator 360 can then pull in or push out his hands to a desired ergonomic starting location.

Upon reaching the intended ergonomic settings, the operator 360 can apply a pulling force on both loop ends along the path that connects his shoulders to the starting position of his hand. This will cause the elastic flexible member 660 to lengthen, causing an increased in head resistance in both the vertical and horizontal direction.

The wrap around portion of elastic flexible member 660 contacting the hinge edge side 580 can be raised to further increase the operator's vertical resistance to the head contact unit 420. This allows the operator to fine tune the varying vertical and horizontal resistance to the level he desires.

Third Alternative Embodiment

Ln reference to FIG. 9, a single-piece version of the exercise device 200 of the Second Alternative Embodiment is shown in the manner of intended use by the operator 220. In this case, the base support end 260 is integral to the head fitting arm 440. And head contact unit 420 is integral to the other end of head fitting arm 440 end in a fixed angle manner.

The head fitting arm 440 comprise of a base support end 260 that has al' shape opening that ends with a key-hole opening. In this embodiment, this key-hole is contemplated to permit a door knob to pass the hole, securing head fitting arm 440 in both vertical and horizontal manner.

It is contemplated that the operator 220 engages with a Force Resistance Device 640, of which discussion from the previous alternative embodiment is repeated here.

Operations:

The device 200 is to be used in conjunction with a Door 540, a projection from door 540 such as a door knob, and a Force Resistance Device 640.

Operator 260 engages with the device 200 in the same manner as described for second alternative embodiment. However, the base support end 260 is connected to a projection from the door 540 such as a door knob, by slipping the door knob through the slot until it resides at the bottom of the key hole.

The operator 220 then performs the same operations for the elastic flexible member 660 around door as discussed above. Further adjustments can be made to Seat Unit 480 to fine tune any vertical adjustment.

Upon reaching the intended ergonomic settings, the operator 360 can apply a pulling force on both loop ends along the path that connects his shoulders to his hand. This will cause the elastic flexible member 660 to lengthen, causing an increased in head resistance in both the vertical and horizontal direction.

The wrap around portion of elastic flexible member 660 contacting the hinge edge side 580 can be raised to further increase the operator's vertical resistance to the head contact unit 420. This allows the operator to fine tune the varying vertical and horizontal resistance to the level he desires.

Illustrations of the Subject Technology as Clauses:

Some example aspects of the subject technology may be represented as clauses. These clauses are examples of the subject technology, and do not limit the subject technology.

1. An apparatus which a user (220) communicates with, comprising of:
   - A base unit (260) whose shape comprising;
   - A first arm projection (340) comprising a first end (380 A) ending along a radiating line from the base unit (260);
   - A second arm projection (440) comprising a second end (420) ending somewhat away from the base unit (260) in a shape that contacts the user's head; whereby upon the urging of the user of the first end (380 A) produces at the second end (420) a force onto the user when the second end (420) is at least in communication with the user's head.
2. The apparatus of clause 1 wherein the second end (420) substantially conforms to a portion of the user head apparatus comes in contact with.
3. The apparatus of clauses 2 wherein the second end (420) is in contact with the underside of the user's head substantially in the chin and throat area, whereby any force onto user will cause a traction load onto the user's neck region.
4. The apparatus of clause 2 wherein the first end (380A) terminates in a location substantially in line with the user's shoulder and at a height between the user's shoulder and waist.
5. The apparatus of clause 4 wherein the apparatus is coupled to a companion apparatus, the apparatus and the companion apparatus being symmetric relative to each other in at least one axis.
6. The apparatus of clause 4 wherein the second arm projection is separably coupled to the base unit (260), the second arm projection (440) further comprising of a third end (460), the third end (460) being configured to engage with the base unit (320 of 240) in a slidably and rotatably adjustable and locking manner.
7. The apparatus of clause 6 wherein the first arm projection (340) is separably coupled to the base unit (260), the first arm projection (340) further comprising of a fourth end (360), the first arm projection (340) being pivotally connected to the base unit (280 of 240) at the fourth end (360), and the user selectively communicating with the first arm projection at the first end (380A).

8. The apparatus of clause 7, wherein the first arm projection (340) is coupled to a companion first arm projection (380B and D), the first arm projection (340) and the companion first arm projection being symmetric relative to each other in at least one axis.

9. The apparatus of clause 7 further comprising of a head fitting unit (420) pivotally and separably coupled to the second in a selectably adjustable and locking manner, whereby the operation of the apparatus results in a force between the head fitting unit (420) and the user that can be adjusted into an at least substantially vertical force and an at least substantially horizontal force.

10. The apparatus of clause 7 to be used in conjunction with a force resistance device, the first arm projection further comprising of a fifth end (380C) that communicates with the force resistance device.

11. The apparatus of clause 8, wherein the first arm projection and the companion first arm projection are connected in a slidably adjustable and locking manner, wherein the distance between both the first arm projection and the companion first arm projection are adjustable in a user selectable manner.

12. The apparatus of clauses 10 wherein the fourth end (360) is pivotally connected to the base unit (280 of 240) in a configuration that applies a downward force onto user during user operation.

13. The Apparatus of clause 10 wherein the base unit further comprising of a sixth end (300) that is substantially located to support user while operating the apparatus.

14. The apparatus of clause 13 further comprising of a seating unit (480) that is slidably connected to the sixth end (300) in a selectably adjustable and locking manner.

15. An apparatus to be used in conjunction with a rigid planar body (540) comprising a projection (Alternate Embodiment 2: Bottom edge of door; Alternate Embodiment 3: Door Knob, not drawn but cited) somewhat normal to the planar body, and in conjunction with a force resistance (640) device a user (220) communicates with, comprising:

A base unit (440) whose shape comprising of;

A first end (420) ending along a radiating line from the base unit;

An aperture (260) sufficiently large enough to communication with the projection wherein the base unit (440) is in communication with the rigid planar body (540), wherein the aperture (also known as base support end 260) is in communication with the projection (see notes above), whereby upon the urging of the user with the force resistance device (640) produces a force onto the user when the first end (420) is in communication with the user's head.

16. The apparatus of clause 15 further comprising of an elongated member (260), wherein the base unit (440) communicates with the rigid planar body (540) in a stationary manner by means of the elongated member (260), wherein the elongated member (260) comprises a seventh end and a eighth end, wherein the seventh end is connected to the aperture (slot 260 also) and the eighth end is connected to the projection.

17. The apparatus of clause 15 wherein the projection comprise of an edge feature (cited) of the rigid planar body (540).

18. The apparatus of clause 15 wherein the projection is a door knob (cited) and the rigid planar body is a door (540).

19. The apparatus of clause 15 wherein the first end (420) substantially conforms to a portion of the user head apparatus comes in contact with.

20. The apparatus of clause 15 further comprising of a head fitting unit (420) pivotally and separably coupled to the first end in a selectably adjustable manner, whereby the force onto the user can be adjusted into an at least substantially vertical force and an at least substantially horizontal force.

CONCLUSIONS, RAMIFICATIONS, AND SCOPE FOR DISBURSEMENT APPARATUS

From the Description and Operations above, a number of advantages of some of my embodiments become evident:

1. The Exercise device 200 is inexpensive to produce, a feature especially seen in the one-piece design encapsulated in the first, second, and third alternate embodiment.
2. The Exercise device 200 allows the user to be in full control so that the device auto-returns to a neutral position in case the user inadvertently loses control of operating the device. This is accomplished by the arm 340 and the Force Resistance Device 640 configured in such manner that only applies load to the operator 220 only when he is grabbing onto the device through handles 380A and B.
3. The Exercise device 200 has the ability to induce corrective lordotic neck curvature, and this is accomplished by the Head Contact unit 420 being adjustable to produce a compressive traction load as well as the required head orientation.
4. The Exercise device 200 has the ability to exercise and strengthen the upper body and back as core supporting muscles for the neck, through the arms 340 (in conjunction with a Force Resistance Device 640) having handles 380A and B that are somewhat in line with the operator's shoulders, and in between his shoulder and waist.
5. The Exercise device 200 has the ability to provide traction load neck strengthening, especially when the arm 340 has its pivot end 360 connected to the frame assembly 240 near the base support end 260, causing a substantial downward force that then produces an upward force onto the user when the head contact unit 420 is in contact with the underside of the user head in chin and neck area.
6. The Exercise device 200 is adjustable for ergonomics and for simulating real collision conditions and for extending the strengthening range, especially when the left and right handles 380A and B can be adjustably spread apart, when the pivot end 360 can pivot from a plurality of holes, and when the head contact unit 420 is both adjustable in angle and in height relative to the operator's head orientation and position.
7. The Exercise device 200 is portable, a feature especially seen in the one-piece design encapsulated in the first, second, and third alternate embodiment.

Although the embodiments show connections connecting non-moving members together, these members can be coupled together by other methods such as welding, epoxy gluing, wrapping, etc. This eliminates the plurality of connections themselves, reducing the assembly complexity (less elements), reducing the weight, as well as cost. Additionally, a connection can be made integral to a member communicating with it in a static way when coupled together. Additionally, an intermediate piece can be wholly eliminated if a member can be bent into the same shape as outlined by an assembly of members and connections. One such possibility is to select a combination of cross sections, wall thickness, material thickness, and shape that would allow the head fitting end (420) of head fitting arm (440) to conform to the desired contacting angle with the user. This would eliminate any extra and supportive elements (430, 460, and 470) as well as pivot-able head fitting unit (420) to accomplish in the manner Alternative Embodiment 1 is able to accomplish. Additionally, arm 440 can be configured similarly for applying traction load onto user's neck, which means the force onto user is in the upwards and behind him direction.

Additionally, the exercise device, especially for the Alternative Embodiments, can be configured whereby the arms 380A and B can be activated using the feet instead of the arms. This can be beneficial in the even a stronger force is need for the user's head that is not achievable using the arms alone.

Additionally, another configuration is to have the feet communicate with a force resistance device in addition to the arms communicating with the exercise device. This would increase the force to the user's head using both feet and hands producing such result.

Additionally, another configuration is to attach a force resistance device to the Head fitting arm 440 so as to increase force onto user's head during operation. Another configuration is to preset the head fitting arm 440 in a manner than introduces as pre-set force onto the user's head before operating the exercise device.

Additionally, the features of die lock features from having the device made with molding technology can be easily overcome with 3D printing. The decreasing cost of investment into this burgeoning technology makes the entry cost cheaper with each passing year. This printing device allows consolidation of non-moving parts that, once was considered die locked and had to be produced as a multi piece setup, is now available as a single unitized piece.

While the above description contains many specificities, these should not be construed as limitations on the scope of any embodiments, but as illustrations of various embodiments thereof. Many other ramifications and variations are possible with the teachings of the various embodiments.

Accordingly, the scope should not be determined by the embodiments illustrated, but by the appended claims and their legal equivalents.

Referring to FIG. 10, FIG. 11, and FIG. 12, another embodiment of an exercise device 800 is shown suitable for use by the operator 220. The exercise device 800 is especially suitable for being supported by a vertical support that defines one or more openings therein, such as illustrated in FIG. 13 and FIG. 14. The exercise device 800 includes a supporting arm 810 that extends in a substantially perpendicular direction to a set of head contacting surfaces 820. The head contacting surfaces 820 preferably include a central surface 830 that is oriented in a substantially perpendicular orientation to the supporting arm 810, a first offset surface 832 that is oriented at an obtuse angle with respect to the central surface 830 and is offset to a first side of the central surface 830, and a second offset surface 834 that is oriented at an obtuse angle with respect to the central surface 830 and is offset to a second side of the central surface 830. Preferably, the first offset surface 832 and the second offset surface 834 are oriented as the same angular offset with respect to the central surface 830. Preferably, the central surface 830, the first offset surface 832, and the second offset surface 834 are maintained in a fixed relationship with respect to one another that is not adjustable by a user. Preferably, the central surface 830, the first offset surface 832, and the second offset surface 834 are maintained in a fixed relationship with respect to the supporting arm 810. Preferably, the central surface 830, the first offset surface 832, and the second offset surface 834 include replaceable padded surfaces attached to the front exterior thereof. The interior of the exercise device 800 may include a first bracing member 842 interconnected between a face 846 of the supporting arm 810, the first offset surface 832, and a portion of the central surface 830. The interior of the exercise device 800 may include a second bracing member 844 interconnected between the face 846 of the supporting arm 810, the second offset surface 834, and a portion of the central surface 830. The first bracing member 842 and the second bracing member 844 are preferably part of a single plate that is maintained in a fixed relationship with respect to the central surface 830, the first offset surface 832, the second offset surface 834, and the supporting arm 810. The first bracing member 842 and the second bracing member 844 provide additional rigidity to the central surface 830, the first offset surface 832, and the second offset surface 834.

An attachment structure 850 is preferably affixed to the supporting arm 810. The attachment structure 850 is suitable for being detachably engaged with the vertical support that defines openings therein. The attachment structure 850 may include a cylindrical rod 860 that is aligned with the supporting arm 810 and positioned at a location offset from the supporting arm 810 using an offset member 870. Referring also to FIG. 13, the cylindrical rod 860 is sized to fit through a selected one of a set of cylindrical openings 900 within the vertical support 910. When engaging the attachment structure 850 with the vertical support 910, the exercise device 800 is preferably rotated out of alignment so that the cylindrical rod 860 may be slidably engaged within a selected opening 910 in a manner such that a retaining tab 920 may does not come into contact with the side of the vertical support 910 during the engagement process. With the cylindrical rod 860 of the attachment structure 850 fully engaged with the vertical support 910, the exercise device 800 may be rotated so that the retaining tab 920 is engaged on the far side of the vertical support 910. The retaining tab 920 inhibits the exercise device 800 from inadvertently disengaging with the vertical support 910, such as by pulling in line with the supporting arm 810. In this manner, the exercise device 800 may be engaged and retained at a suitable height along the vertical support 910 consistent with the head of the user. Further, the exercise device 800 includes the set of three surfaces, so that support may be achieved from below the exercise device 800, from a direction generally horizontal with the exercise device 800, and from above the exercise device 800. Referring to FIG. 14, the exercise device 800 may be used in combination with other structures, such as a pair of stretchable resistance bands 925 that are maintained in a fixed position with respect to the exercise device 800.

I claim:

1. An apparatus which a user communicates with, comprising a base portion:

said base portion including a head engagement portion coupled to a stationary portion, said head engagement portion adapted to receive a selected front region of the user's head against it, said head engagement portion including a head fitting arm and a head contacting unit, said head contacting unit including an exterior surface that is the farthest distant surface from said base portion to which is attached a padded surface, said padded surface replaceably attachable to said exterior surface, said head fitting arm suitable for readily detachably engaging said stationary portion, said padded surface of said head contacting unit said adapted to receive said selected front region of said user's head against it in a direct surface-to-surface pressing engagement, said head fitting arm integral with said head contacting unit in such a manner that said head contacting portion is incapable of angular adjustment with respect to said head fitting arm, said head fitting arm integral with said head contacting unit in such a manner that said head contacting portion is incapable of movable adjustment with respect to said head fitting arm, an attachment structure interconnected with said head fitting arm, said attachment structure including a cylindrical member, said attachment structure including an offset member supporting said cylindrical member at an offset location from said head fitting arm, said attachment structure including a retaining tab arranged to extend in a direction away from said head fitting arm, a terminal portion of said cylindrical member located a distance further from said head contacting unit than a terminal portion of said retaining tab, wherein said cylindrical member is configured to detachably engage with said stationary portion by extending through an opening defined by said stationary portion while said retaining tab is arranged to be extend around a portion of said stationary portion in such a manner that said head engagement portion is incapable of being disengaged with said stationary portion by moving said head engagement portion in a direction aligned with said cylindrical portion while said retaining tab is extended around said portion of said stationary portion, wherein said head contacting until includes a central surface suitable for receiving said front region of the user's head against it, a first offset surface suitable for receiving said front region of the user's head against it oriented at an obtuse angle with respect to said central surface; a second offset surface suitable for receiving said front region of the user's head against it oriented at an obtuse angle with respect to said central surface, where said first offset surface and said second offset surface are positioned at opposing sides of said central surface.

2. The apparatus of claim 1 wherein said central surface, said first offset surface, and said second offset surface are incapable of movement with respect to one another.

3. The apparatus of claim 2 wherein said central surface, said first offset surface and said second offset surface are incapable of movement with respect to said head fitting arm.

4. The apparatus of claim 3 further comprising a first bracing member interconnected between said central surface, said first offset surface, and said head fitting arm.

5. The apparatus of claim 4 further comprising a second bracing member interconnected between said central surface, said second offset surface, and said head fitting arm.

6. An apparatus which a user communicates with, comprising a base portion, (a) said base portion including a head engagement portion coupled to a stationary portion, said head engagement portion adapted to receive a selected front region of the user's head against it, said head engagement portion including a head fitting arm and a head contacting unit, said head fitting arm suitable for readily detachably engaging said stationary portion, said head contacting unit said adapted to receive said selected front region of said user's head against it, said head fitting arm integral with said head contacting unit in such a manner that said head contacting portion is incapable of angular adjustment with respect to said head fitting arm, said head fitting arm integral with said head contacting unit in such a manner that said head contacting portion is incapable of movable adjustment with respect to said head fitting arm, an attachment structure interconnected with said head fitting arm, said attachment structure including a cylindrical member, said attachment structure including an offset member supporting said cylindrical member at an offset location from said head fitting arm, said attachment structure including a retaining tab arranged to extend in a direction away from said head fitting arm, a terminal portion of said cylindrical member located a distance further from said head contacting unit than a terminal portion of said retaining tab, wherein said cylindrical member is configured to detachably engage with said stationary portion by extending through an opening defined by said stationary portion while said retaining tab is arranged to be extend around a portion of said stationary portion in such a manner that said head engagement portion is incapable of being disengaged with said stationary portion by moving said head engagement portion in a direction aligned with said cylindrical portion while said retaining tab is extended around said portion of said stationary portion;

(b) wherein said head contacting until includes a central surface suitable for receiving said front region of the user's head against it, a first offset surface suitable for receiving said front region of the user's head against it oriented at an obtuse angle with respect to said central surface; a second offset surface suitable for receiving said front region of the user's head against it oriented at an obtuse angle with respect to said central surface, where said first offset surface and said second offset surface are positioned at opposing sides of said central surface.

7. The apparatus of claim 6 wherein said central surface, said first offset surface, and said second offset surface are incapable of movement with respect to one another.

8. The apparatus of claim 7 wherein said central surface, said first offset surface and said second offset surface are incapable of movement with respect to said head fitting arm.

9. The apparatus of claim 8 further comprising a first bracing member interconnected between said central surface, said first offset surface, and said head fitting arm.

10. The apparatus of claim 9 further comprising a second bracing member interconnected between said central surface, said second offset surface, and said head fitting arm.

* * * * *